United States Patent [19]

Porter et al.

[11] 4,119,534

[45] Oct. 10, 1978

[54] MULTIPLE DECK TROMMEL SCREEN

[75] Inventors: Stuart M. Porter; Francis Edward Litty, both of Denver; Ervin C. Weimer, Wheat Ridge; Eric G. Pollack, Denver, all of Colo.

[73] Assignee: Stearns-Roger Corp., Glendale, Colo.

[21] Appl. No.: 778,876

[22] Filed: Mar. 18, 1977

[51] Int. Cl.[2] ..... B07B 1/24

[52] U.S. Cl. ..... 209/291

[58] Field of Search ..... 34/135, 136; 209/288-291, 284, 293, 295, 296, 404-406, 315-317; 241/40, 74

[56] References Cited

U.S. PATENT DOCUMENTS

| | | | |
|---|---|---|---|
| 1,037,371 | 9/1912 | Tscherning | 209/291 |
| 1,182,680 | 5/1916 | Hemings | 209/291 |
| 1,596,428 | 8/1926 | Greene | 209/291 |
| 1,819,049 | 8/1931 | Weimer | 209/290 |
| 3,073,449 | 1/1963 | Johanningmeier | 209/288 |
| 3,076,270 | 2/1963 | Madsen | 209/290 |

*Primary Examiner*—William A. Cuchlinski, Jr.
*Assistant Examiner*—Jon Hokanson
*Attorney, Agent, or Firm*—Sheridan, Ross, Fields & McIntosh

[57] ABSTRACT

A multiple deck trommel screen is provided having at least an inner course screen and an outer fine screen, both having a diameter greater than the rotating drum to which they are attached for separating fines from course material. A deflector plate is provided at the end of the trommel screen for impingement of air-borne particles so that they fall on the inner trommel screen. A first hopper is provided under the outer trommel screen for receiving the fines and a second hopper is provided beyond the end of both of the trommel screens for receiving the course material. The outer trommel screen is made up of generally flat screen sections which extend as chords around the periphery of a trommel screen frame.

4 Claims, 6 Drawing Figures

MULTIPLE DECK TROMMEL SCREEN

BACKGROUND OF THE INVENTION

1. Field of the Invention

This invention relates to a multiple deck trommel screen, and more particularly to a multiple deck trommel screen for use in separating fine particles emerging from the end of a rotary drum dryer.

2. Description of the Prior Art

Rotary screen separators for separating fines from larger particulate material is well known. For example, in U.S. Pat. No. 1,182,680 to Hemings, a rotary chip screen is provided having an inner course screen section and an outer fine screen section for separating fine material from larger chips. U.S. Pat. No. 1,596,428 to Greene discloses a dryer and separator for sand and the like, having concentric screens arranged with the inner screens being more course than the outer screens for selective separation of material by size. Other rotary screening devices are shown in U.S. Pat. No. 1,819,049 to Weimer, and in U.S. Pat. No. 3,073,449 to Johanningmeier.

A disadvantage with most prior art devices is overloading of the outer screens whereby the material is not thoroughly mixed so the fines can sift past the larger material to the outer surface to pass through the screen. Furthermore, inadequate agitation at the surface of the outer screen also results in many of the fines being blocked from reaching the screen. Furthermore, fine air-borne particles often are carried over the end of the courser screen and into the recepticle for the course material rather than being deflected so as to pass through the screens and into the recepticle for the fines.

SUMMARY OF THE INVENTION

In accordance with this invention, a multiple deck trommel screen is provided which includes a frame attached to the outlet of a rotary dryer, the frame having an inner course screen and an outer fine screen, both of which are of greater diameter than the dryer. A first hopper is provided under the outer screen for receiving the fines, and a second hopper is provided adjacent the lip of the screens for receiving the larger material which does not pass through both screens.

More particularly, the invention includes an impact plate mounted within the screens for deflecting air-borne particles from the dryer against the surface of the inner screen so that the particles will pass through the screens and into the first hopper. Also, the outer screen is segmented having straight screen sections each defining a chord along the periphery of the frame. The segmented screen sections are held in place by respective angle members which also assist in the agitation of the material on the outer screen thereby assuring more thorough mixing and therefore the passage of more of the fines through the outer screen.

Thus, the advantages of this invention are readily apparent. A multiple deck trommel screen is provided which deflects air-borne fines against the screens and wherein the inner screen prevents overloading of the outer screen and the outer screen is arranged in chord segments that are attached to the frame by angle members which serve as agitators to thoroughly mix the material so that a greater percentage of the fines pass through the outer screen.

Additional advantages of the invention will be apparent from the description which follows, taken in conjunction with the accompanying drawings.

DESCRIPTION OF THE PREFERRED EMBODIMENT

Figure 1:
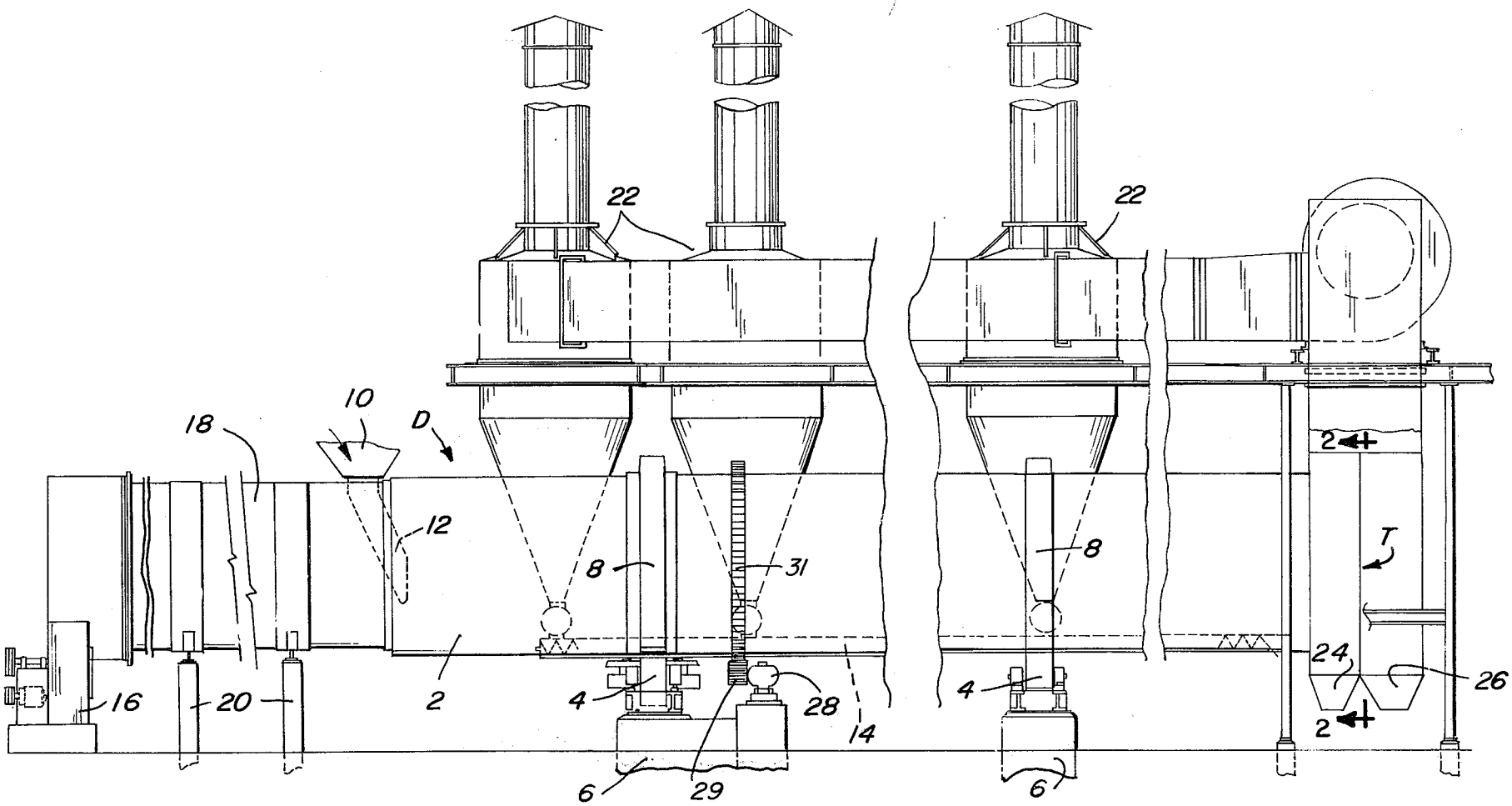
FIG. 1 is a fragmentary side elevation of a rotary dryer system utilizing the multiple deck trommel screen of this invention.
Figure 2:
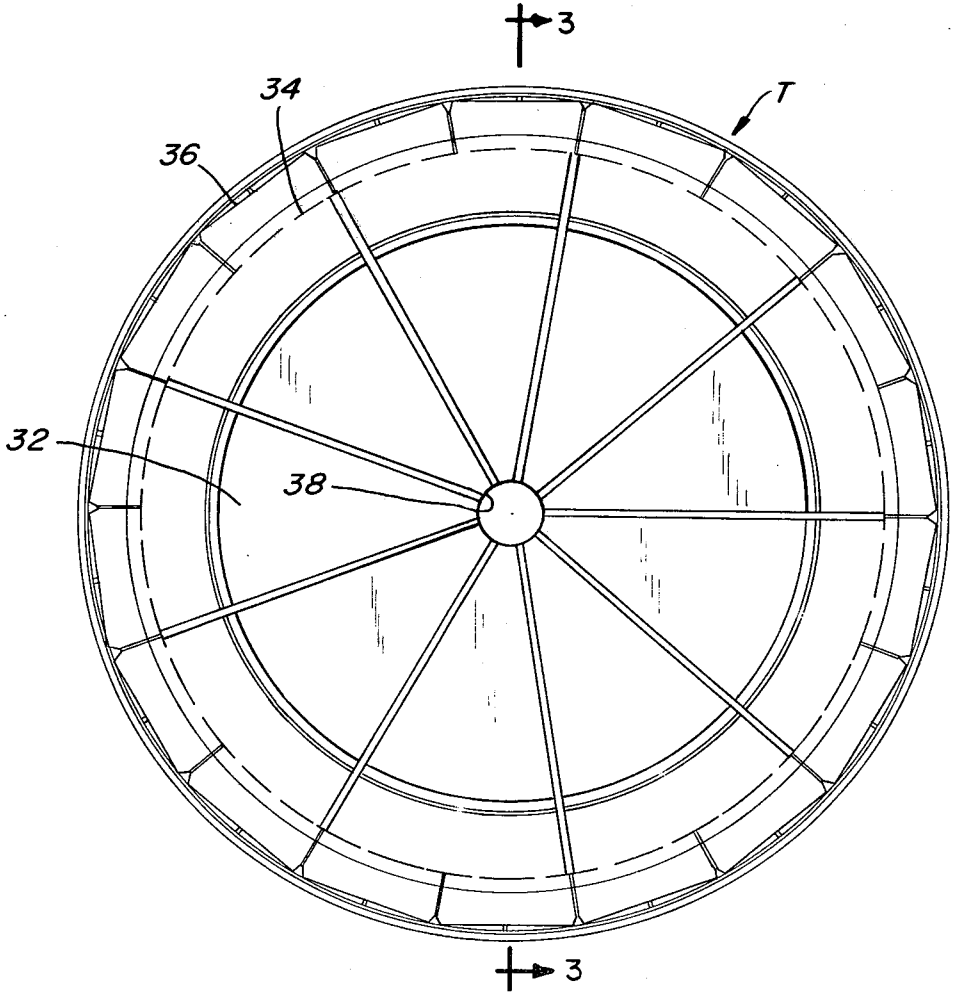
FIG. 2 is an enlarged vertical section, taken along line 2—2 of FIG. 1, showing the structural configuration of the frame for holding the inner and outer trommel screens.

In accordance with this invention, a rotary dryer D is provided which includes an imperforate drum 2 supported in a generally horizontal position by rollers 4 which are journaled on supports 6 and engage a track or guide 8 around the periphery of the drum 2. Conveniently, material to be dried is supplied through a hopper 10 and a chute 12 at the inlet end of drum 2 where it is fed by auger 14 toward the outlet or discharge end. Also, if desired, the drum 2 may be tilted from the inlet to the outlet so that gravity assists in feeding the material. Any particulate material may be dried by this equipment, but it has particular application for bark, wood pulp and similar organic material.

Hot air for drying the material is provided by means of a blower 16 mounted ahead of the forward end of the drum 2 and is connected thereto by a conduit 18 mounted on supports 20 as shown. Spaced along drum 2 are a plurality of dust collectors 22, as shown, for removing dust from drum 2 as the material is dried and moves therealong.

Figure 3:
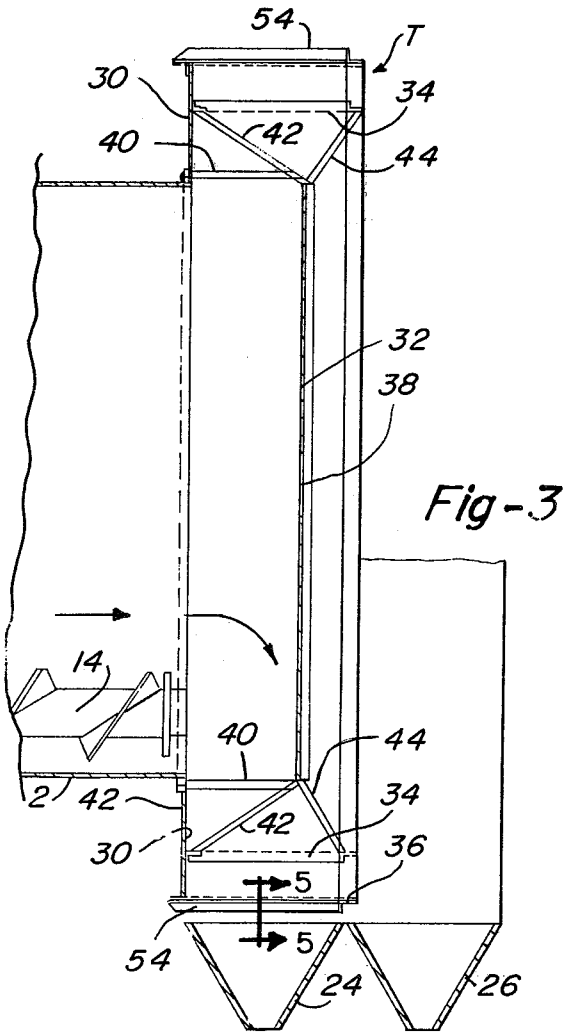
FIG. 3 is a vertical section, taken along line 3—3 of FIG. 2, showing further details of the frame construction of the trommel screen and the flow of material to the trommel screens.
Figure 6:
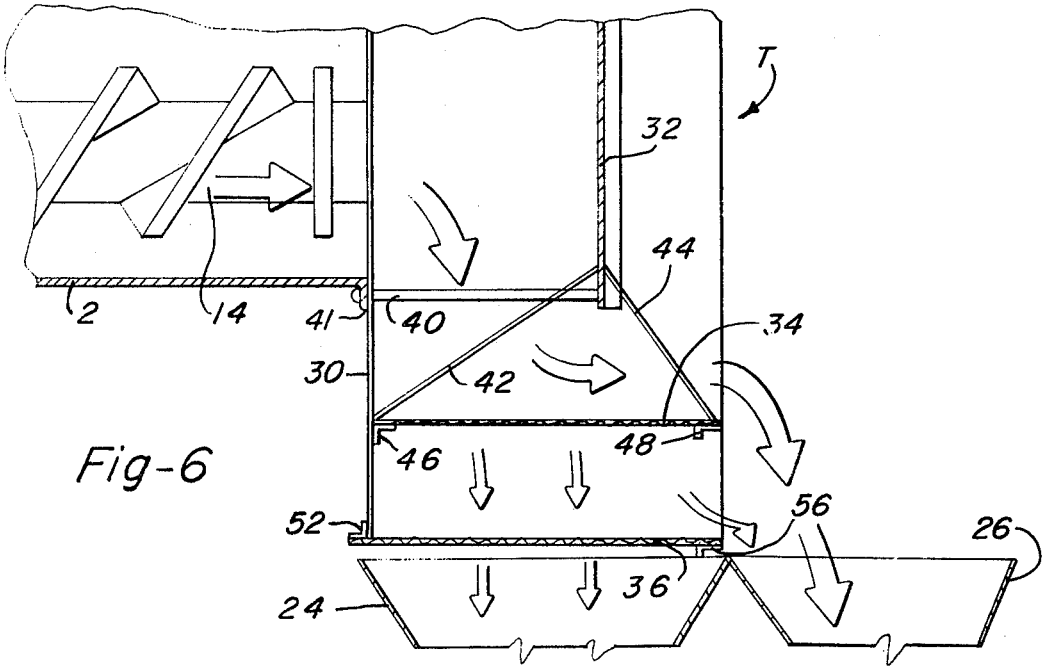
FIG. 6 is an enlarged vertical fragmentary section of a portion of FIG. 3 showing further details of the manner in which the material flows across and through the trommel screens.

Connected to the discharge end of drum 2 is the muti-deck trommel screen T of this invention, which separates the fines for discharge into a first hopper 24 separating them from the larger material which is discharged into hopper 26. Conveniently, drum 2 is rotated by means of motor 28 having a spur gear 29 whose teeth engage a circular gear 31 which surrounds drum 2 as shown and is fixedly attached thereto. As the drum rotates, auger 14 will feed the material toward the discharge end. By the time the material reaches the discharge end it should be thoroughly dried and will be discharged onto the trommel screen device T of this invention, as best understood by referring to FIGS. 3 and 6.

As the material flows over the end of the discharge chute, it will fall between rear plate 30 of the trommel screen structure and target plate 32 onto an inner screen which is coarse and has openings on the order of 1.0 inch across so that all material greater than 1.0 inch will be retained by the screen, whereas the smaller material will fall through inner screen 34 onto outer screen 36. The largest diameter of the screens with respect to the drums allows the material to fall from the drum to the screens which assists agitation and therefore separation. Conveniently, the target 32 serves as an impingement surface against which air-borne particles strike so that they drop into the inner screen 34 to be separated along with the rest of the material. Target 32 has a center opening 38, such as two feet in diameter, for allowing one to view the drying operation and also to provide an access opening for a fire extinguisher should any of the drying material catch on fire.

Conveniently, target plate 32 and screens 34 and 36 are mounted on a cylindrical frame formed by means of diagonal and horizontal struts as well as rear plate 30. The horizontal struts may take the form of rods 40 which are shown as serving as the attachment means for connecting the trommel screen device T to the outwardly extending flange 41 at the discharge end of drum 2. The opposite end of rod 40 is connected, as by welding, to the peripheral edge of target plate 32. Diagonal braces 42 extend between the peripheral edge of target plate 32 and the approximate mid-point of rear plate 30 adjacent the inner edge of inner screen 34 and an outer diagonal brace extends from the front peripheral edge of target plate 32 to the front of inner screen 34, as shown.

Figure 4:
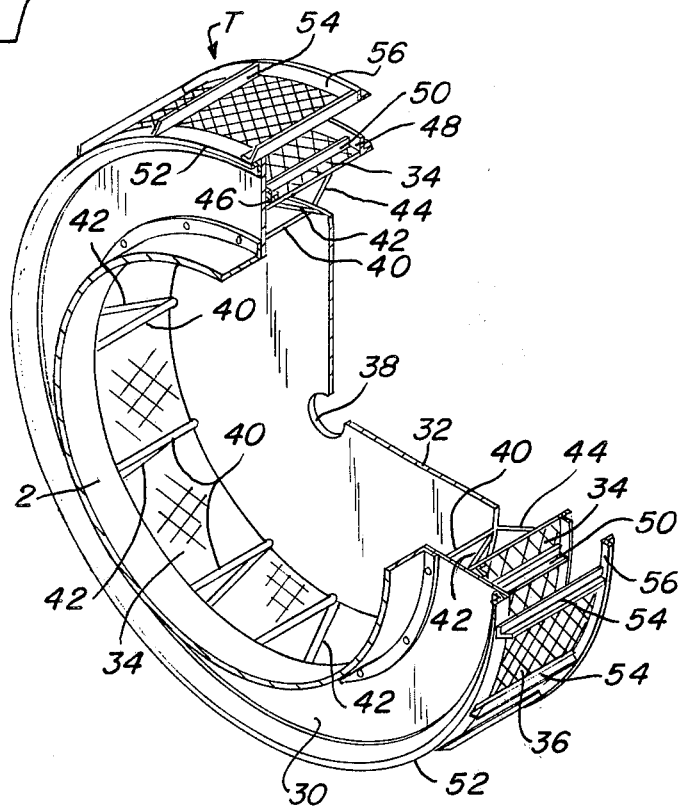
FIG. 4 is a fragmentary perspective view of the multiple deck trommel screen of FIGS. 1–3, showing further details of the construction thereof.

Inner screen 34 is supported at its inner edge by angle 46, which is attached to inner plate 30, as by welding and extends annularly therearound. The outer edge of inner screen 34 is supported by outer angle 48 which is supported by outer struts or braces 44. As best seen in FIG. 4, spaced around the outer surface of inner screen 34 are cross braces 50 for supporting the surface of the screen. In this embodiment, a cylindrical frame including rods 40, braces 42, struts 44, and an annular support member in the form of rear plate 30 is shown to support inner screen 34, outer screen 36, and impact plate 32.

Figure 5:
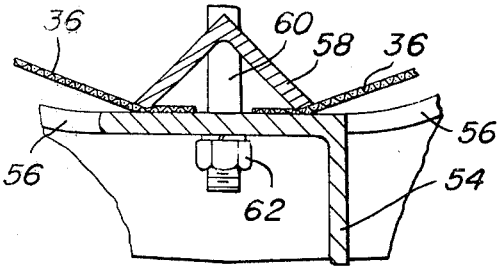
FIG. 5 is an enlarged section, taken along line 5—5 of FIG. 3, showing details of the angle members for connecting the outer screen segments to the frame.

Around the outer edge of inner plate 30 is an inner angle member 52 to which cross angles 54 are attached, as by welding, as best seen in FIG. 4 whose outer edges support outer angle member 56 which supports the outer peripheral edge of trommel screen device T. The screen segments 36 are attached to the cross angles 54 by means of inverted V-shaped agitator members 58, whose lower edges clamp the ends of adjacent screen sections 36, as best seen in FIG. 5 against the horizontal flange of alternate cross members 54. Agitators 58 are held in place by means of bolts 60 drawn tight by means of nut 62. As the fine material falls through inner screen 34 and on to outer screen 36, it is agitated and caused to be mixed by agitators 58 which serve this advantageous dual purpose of agitating the material and of clamping the screen sections in place. Conveniently, outer screen 36 may be of a fine mesh of say, no greater than one-eighth openings so that only material less than one-eighth inch will pass therethrough into hopper 24, whereas all other material which does not pass through either inner screen 34 or outer screen 36 will be discharged over the ends thereof, respectively, into hopper 26.

The fines collected in hopper 24 can be used in a suspension burner as fuel, whereas the larger material collected in hopper 26 can be used as boiler fuel. Such an arrangement cuts down on the oil required by the boilers, and therefore, helps to meet pollution control standards.

From the foregoing, the advantages of this invention are readily apparent. The deflector plate or target plate 32 serves to provide an impingement surface for air-borne particles so that they drop down on to the screens for separation. Also, by having the screens of larger diameter than rotating drum 2, the material can fall downwardly off the end of the drum thereby aiding in mixing and therefore separation as the material passes through the screens. The fine material which passes through screen 34 is caught on screen 36 and mixed by agitators 58 which serve the dual purpose of agitating the material and of clamping the ends of screen sections 36 to cross members 54. Thus, a very thorough mixing and effective separation can be made so that nearly all of the fines pass through screen 36 into hopper 24, whereas all of the larger particles are discharged over the ends of screens 34 and 36 into hopper 26 for future use, such as fuel for boilers.

The invention has been described in detail with particular reference to preferred embodiments thereof, but it will be understood that variations and modifications can be effected within the spirit and scope of the invention.

What is claimed is:

1. A multiple deck trommel screen device for connection to the discharge end of a cylindrical imperforate drum of a generally horizontal rotatable dryer for separating fines from particulate material, wherein the fines are collected in a first hopper and the rest of the particulate material is caught in a second hopper, said trommel screen device comprising:

a generally cylindrical frame for supporting at least inner and outer concentrically mounted supporting screens connectible to the discharge end of the drum;

said inner cylindrical screen mounted on said frame and having a diameter greater than the drum and having a relatively coarse mesh;

said outer cylindrical screen mounted on said frame concentric with said inner screen and having a diameter greater than said inner screen and being of fine mesh through which only the fines can pass, said frame being connectible to the discharge end of the drum so that all fines passing through both screens are collected in the first hopper and all particulate material passing over the end of said screens is collected in the second hopper;

said outer screen being made up of individual screen segments secured to said frame by agitator members on the inner side of said frame, said agitator members clamping the edges of said inner screen sections to said frame and serving to mix the material passing through said inner screen to cause as many of said fines to engage the surface of said outer screen as possible and to pass therethrough;

said agitator members each including an inverted V-shaped member extending parallel to the longitudinal axis of said trommel screen device; and bolts having one end connected to said V-shaped member and extending through cross members on said frame, the edges of said screen sections being positioned between the ends of said V-shaped member and said cross members and held in place when said bolts are tightened.

2. A multiple deck trommel screen device for connection to the discharge end of a cylindrical imperforate drum of a generally horizontal rotatable dryer for separating fines from particulate material, wherein the fines are collected in a first hopper and the rest of the particulate material is caught in a separate hopper, said trommel screen device comprising:

a generally cylindrical frame having cross members for supporting at least inner and outer concentrically mounted supporting screens connectible to the discharge end of the drum;

said inner cylindrical screen mounted on said frame and having a diameter greater than the drum and having a relatively coarse mesh; and said outer cylindrical screen mounted on said frame concentric with said inner screen and having a diameter greater than said inner screen and being of fine mesh through which only the fines can pass, said frame being located so that all fines passing through both screens are collected in the first hopper and all particulate material passing over the end of said screens is collected in the second hopper;

said outer screen being made up of individual screen segments secured to said frame by agitator members on the inner side of said frame, said agitator members clamping the edges of said inner screen sections to said frame and serving to mix the material passing through said inner screen to cause as many of said fines to engage the surface of said outer screen as possible and to pass therethrough;

said agitator members each including an inverted V-shaped member extending parallel to the longitudinal axis of said trommel screen device;

bolts having one end connected to said V-shaped member and extending through cross members on said frame, the edges of said screen sections being positioned between the ends of said V-shaped member and said cross members and held in place when said bolts are tightened;

an impact plate mounted within said frame, transverse to the flow of particulate material and having a diameter less than that of said inner screen but at least equal to the diameter of the drum, said plate serving as a surface against which air-borne particles impinge and then fall against said inner screen for separation; and an opening in the center of said impact plate for viewing the particulate material within the dryer and through which any fires can be extinguished which may occur within the dryer.

3. A multiple deck trommel screen device for use with a generally cylindrical imperforate drum of a rotary dryer for separating fines from particulate material, wherein the fines are collected in a first hopper and the remaining particulate material is collected in a second hopper, said trommel screen device being connectible to the discharge end of the drum, wherein the drum is rotatable about a generally horizontal axis, said trommel screen device comprising:

an annular support member having an inner and outer peripheral edge, the inner peripheral edge being connectible to the discharge end of the drum, said support member lying in a plane perpendicular to said axis when connected to said drum;

an inner cylindrical screen having a relatively coarse mesh and a diameter greater than that of said inner peripheral edge of said support member and less than the diameter of said outer peripheral edge of said support member, said inner screen being connected to said support member intermediate said edges of said support member and mounted concentric therewith, an outer cylindrical screen having a smaller mesh than said inner screen through which only the fines can pass, said outer screen being mounted concentric with said inner screen and having a diameter greater than said inner screen, said outer screen being connectible to said support member at the outer periphery of said support member, so that all fines passing through both screens are collected in the first hopper located below the trommel screen device and all particulate material passing over the end of said screens is collected in the second hopper adjacent the first hopper;

a circular impact plate having a diameter less than the diameter of said inner screen mounted spatially within the peripheral edges of said inner screen, transverse to the flow of particulate material to block the flow of airborne particles so that they fall down onto the inner screen; and means interconnecting said impact plate and said support member for supporting said impact plate within the peripheral edges of said inner screen.

4. The device, as claimed in claim 3, wherein said inner screen has an inner edge and an outer edge and said interconnecting means includes:

a plurality of braces spaced around the peripheral edge of said impact plate and connected between the peripheral edge of said impact plate and said support member adjacent the connection of said inner edge of said inner screen to said support member; and a plurality of struts spaced around the peripheral edge of said impact plate opposite each of said braces, said struts being connected between said impact plate and said outer edge of said inner screen thereby providing support for said inner screen.

* * * * *